United States Patent [19]

Kim

[11] Patent Number: 4,620,812

[45] Date of Patent: Nov. 4, 1986

[54] SUPER FASTENER

[76] Inventor: Nam Kyun Kim, 306 W. Houghton Ave., Houghton, Mich. 49931

[21] Appl. No.: 755,303

[22] Filed: Jul. 15, 1985

[51] Int. Cl.[4] ..... B42F 13/02; B42F 13/08

[52] U.S. Cl. ..... 402/68; 402/14

[58] Field of Search ..... 402/14, 15, 16, 68

[56] References Cited

U.S. PATENT DOCUMENTS

| | | | |
|---|---|---|---|
| 1,658,052 | 2/1928 | Kline . | |
| 2,526,975 | 10/1950 | Siegfried | 402/14 X |
| 2,536,792 | 1/1951 | Windt | 402/68 X |
| 2,637,326 | 5/1953 | Witz | 402/14 |

FOREIGN PATENT DOCUMENTS

| | | | |
|---|---|---|---|
| 630209 | 5/1936 | Fed. Rep. of Germany | 402/14 |
| 2163768 | 5/1980 | Fed. Rep. of Germany | 402/68 |
| 870006 | 6/1961 | United Kingdom | 402/14 |

*Primary Examiner*—Paul A. Bell

*Attorney, Agent, or Firm*—Terence J. Linn

[57] ABSTRACT

A fastener for securing files of paper, documents, and the like that consists of a base having two side sheet retainers and two additional center sheet retainers. A keeper therefore has three equally spaced perforations through which the sheet retainers pass and are bent, to be held down in the keeper groove by locks. Two center sheet retainers project through the center perforation and are bent in opposite directions to be locked.

5 Claims, 11 Drawing Figures

PRIOR ART

SUPER FASTENER

FIELD OF THE INVENTION

This invention relates to fasteners which are used to secure paper, letters, documents, and the like for filing or binding, and in particular to fasteners that consist of a base having sheet retainers which pass through paper or holes in paper such as are created by a paper hole puncher, to be secured through equally spaced perforations in a keeper over which the sheet retainers are bent, and secured by locks mounted on the keeper.

BACKGROUND

A cross-sectional view of a conventional fastener is shown in FIG. 1. The figure illustrates how the fastener secures a stack of documents, with two side sheet retainers stemming from the body of the base, and a keeper. The keeper consists of a strip of metal with two longitudinal raised strips along both longitudinal edges to increase the stiffness of the keeper, and two sliding locks. Two side sheet retainers pass through the holes in the paper and the two side perforations of the keeper sit on the top of the paper file. The purpose of the locks is to hold the ends of the sheet retainers down into the groove between the raised strips of the keeper. The locks can be moved over the entire length of the keeper and be held at any position due to resilience of the metal sheet retainers. Both ends of the keeper are either slightly wider or have a depressed notch so that the locks may not escape from the keeper.

When the space between two side perforations of the keeper is eight and a half inches, the fastener leaves the center portion of the paper loose, particularly when the volume of the paper increases. Also, the locks tend to slide away from the desired location on the sheet retainers due to lack of resilience of the sheet retainers. In prior fasteners utilizing only two side sheet retainers on the base, when the locks are not in the desired position due to lack of resilience (this is most often the case), the ends of the sheet retainers became loose, resulting in insecure binding. This is more obvious as the thickness of paper increases and/or the distance between the side perforations increase.

SUMMARY OF THE INVENTION

The present invention is embodied in a fastener which comprises a base having two center sheet retainers along with two side sheet retainers, and a keeper having equally spaced perforations through which the ends of the four sheet retainers are projected and bent to be secured by locks. Another aspect of the invention is a method to securely lock the ends of four sheet retainers by pressing out two consecutive raised mounts on the sheet retainers to accommodate a lock near the end of each sheet retainer.

The present fastener device provides a more effective fastener with no or minor additional metal, yet provides an additional securing power over the conventional fastener. Further, the present invention provides an effective design to hold the ends of the sheet retainers securely in the groove of the keeper. These and other objects and advantages of the invention will be recognized as it is described in the following specification with reference to the accompanying drawings.

DETAILED DESCRIPTION OF THE PREFERRED EMBODIMENTS

Figure 1:
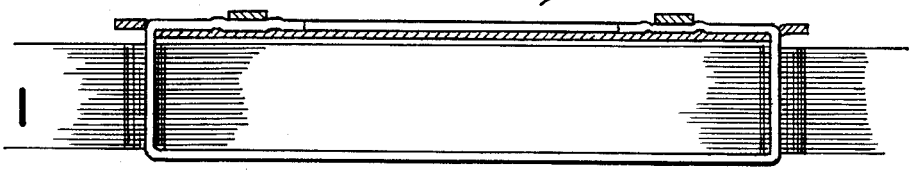
FIG. 1 is a side sectional view of a prior art fastener.
Figure 2:
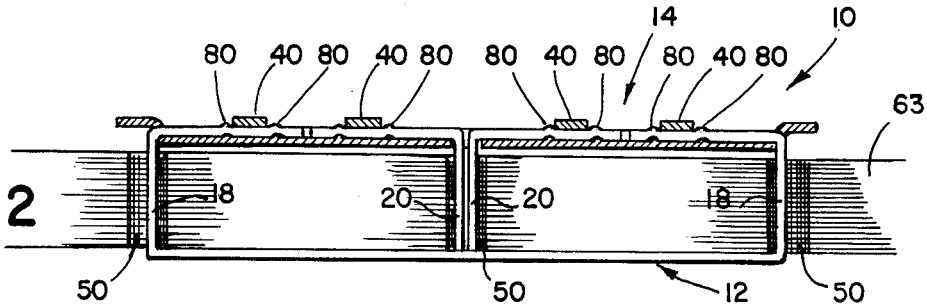
FIG. 2 is a cross-sectional view of the improved fastener embodying the present invention shown in use, and having two additional sheet retainers created from the base.

The invention is embodied in a fastener, a preferred form of which is shown in FIG. 2 and referenced generally by the numeral 10. Fastener 10 includes a base 12 and a separate keeper 14. Base 12 (FIG. 3) includes an elongated body 16 with two side sheet retainers 18 located at the two opposite ends thereof. Two center sheet retainers 20 are joined to body 16 between side sheet retainers 18. Keeper 14 (FIG. 4) includes an elongated central region 30 surrounded by a pair of raised lips 32 extending along the two longitudinal edges thereof and a pair of raised side edges 34 at each end. Two side apertures or perforations 36 open through keeper 14 adjacent raised side edges 34, and a center aperture or perforation 38 is located between side apertures 36. Four locks 40 are slidably mounted on keeper 14.

Figure 5:
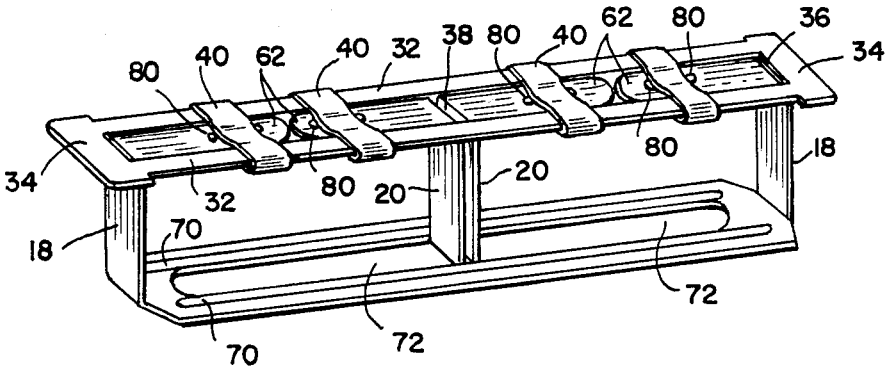
FIG. 5 is a perspective view of the fastener of FIG. 2, shown in a condition of use.

When assembled sheet retainers 18 and 20 are bent up and pass through holes 50 on the stacked sheets of paper 63. Side sheet retainers 18 are received through side apertures 36, and center sheet retainers 20 are both received through center aperture 38. Sheet retainers 18 and 20 are bent over against keeper 14 (FIG. 5) and locks 40 are slid to maintain sheet retainers 18 and 20 in a locked condition.

Figure 3:
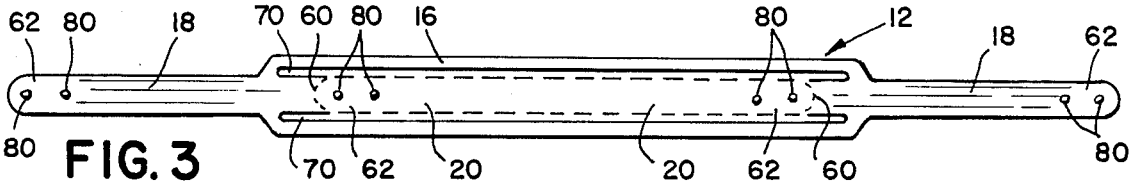
FIG. 3 is a plan view of the base of the fastener of FIG. 2, shown in unassembled condition indicating in phantom the cuts for two center sheet retainers to be made.

The center sheet retainers 20 are created from the body 16 of base 12 by cutting along a pair of dotted lines 60 shown in FIG. 3. Center sheet retainers 20 are pushed upward in the same direction as side sheet retainers 18. Center sheet retainers 20 double the two existing side sheet retainers 18 on the sides of fastener 10 without additional cost of metal. The ends 62 of center sheet retainers 20 project through center perforation 38, in the same fashion as the ends 62 of side sheet retainers 18 pass through holes 50 in paper 63 and side perforations 36 on keeper 14, with keeper 14 resting upon the file of paper 63. Base 12 preferably has two longitudinal raised ribs 70 on the lower face of body 16, as shown in FIG. 3. Ribs 70 stiffen the metal of body 16 alongside the large holes 72 (FIG. 5) left out by the creation of center sheet retainers 18.

Two consecutive mounts 80 are spaced to accommodate one of locks 40 in between mounts 80. Mounts 80 are raised dimples that lock 40 is pressed or slid over by a thumb on the end of each sheet retainer. Mounts 80 limit lock 40 from sliding along the keeper 14 once lock 40 is positioned.

Figure 4:
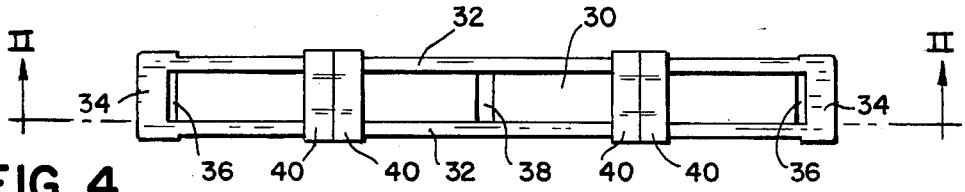
FIG. 4 is a top plan view of the keeper of FIG. 2, shown in unassembled condition.

Keeper 14 includes three perforations 36 and 38, with center perforation 38 twice as wide as side perforations 36, and four sliding locks as shown in FIG. 4. Each lock 40 is assigned to hold down one end 62 of the four sheet retainers 18 and 20. Since the depth of the groove 30 in keeper 14 is designed to accommodate two overlapping sheet retainers 18 and 20, lock 40 may need a slight depression by a thumb to give the right amount of friction between lock 40 and sheet retainers 18 or 20 when only one sheet retainer 18 or 20 is held down.

Figure 6:
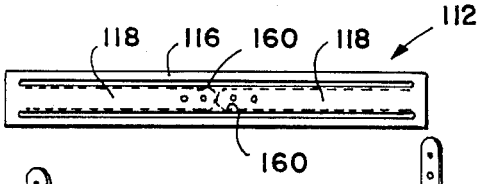
FIG. 6 is a plan view of a fastener base forming a second embodiment of the invention, shown in unassembled condition indicating in phantom the cuts for two side sheet retainers to be made.
Figure 7:
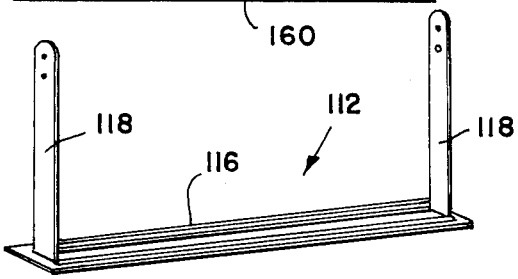
FIG. 7 is a perspective view of the base of FIG. 6, shown with the side sheet retainers extended upward.

An alternative preferred fastener 100 is shown in FIG. 6 and FIG. 7, which includes an alternative way to make a pair of side sheet retainers 118 from the metal of a body 116 of a base 112. Two side sheet retainers 118 are created from body 116 by cutting along the dotted lines 160 and pushing sheet retainers 118 upward, pivoting sheet retainers 118 at both ends of body 116. This saves metal relative the formation of two side sheet retainers of a conventional fastener base.

Figure 8:
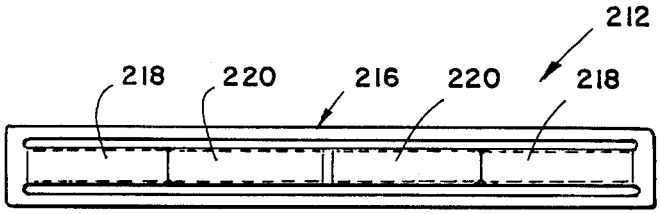
FIG. 8 is a plan view of a fastener base forming a third embodiment of the invention shown in unassembled condition indicating in phantom the cuts to be made for two short side sheet retainers as well as two short center sheet retainers.
Figure 9:
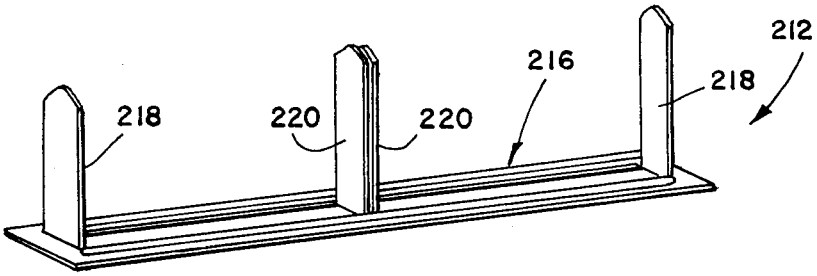
FIG. 9 is a perspective view of the base of FIG. 8, shown with the short side and center sheet retainers extended upward.

Another alternative base for a fastener is shown in FIG. 8 and FIG. 9 and referenced generally by numeral 212. On base 212 metal from a body 216 of base 212 is used to form both side sheet retainers 218 as well as center sheet retainers 220. In this case the lengths of sheet retainers 218 and 220 are relatively short, since two side sheet retainers 218 and two center sheet retainers 220 are formed from the limited source of metal pressed up from body 216. The use of base 212 is appropriate when the volume of paper is thin.

Figure 10:
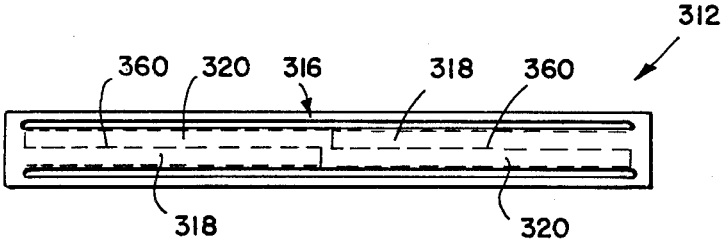
FIG. 10 is a plan view of a fastener base forming a fourth embodiment of the invention shown in unassembled condition indicating in phantom the cuts to be made for two thin side sheet retainers as well as two thin center sheet retainers.
Figure 11:
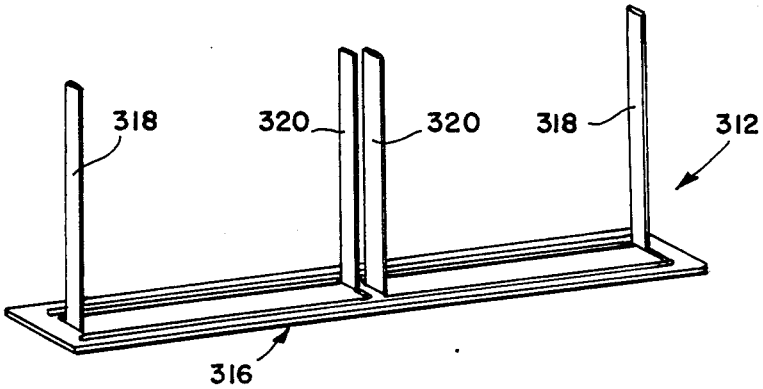
FIG. 11 is a perspective view of the base of FIG. 10 with the side sheet retainers and center perspective sheet retainers extended upward.

Still another alternative preferred embodiment of a base for a fastener is shown in FIG. 10 and FIG. 11 and referenced generally by numeral 312. Base 312 includes a body 316 with two side sheet retainers 318 and two center sheet retainers 320 which are of normal length relative to sheet retainers 18 and 20, but narrower in width than sheet retainers 18 and 20. Sheet retainers 318 and 320 are cut longitudinally in half along lines 360. The keeper 14 shown in FIG. 4 can be used for base 312.

It is to be understood that the above is merely a description of the preferred embodiment and that various modifications or improvements may be made without departing from the spirit of the invention disclosed herein. The scope of protection to be afforded is to be determined by the claims which follow and the breadth of interpretation which the law allows.

The embodiments of the invention in which an exclusive property or privilege is claimed are defined as follows.

I claim:

1. A fastener for sheet material, comprising:

a base having a body with two bendable side sheet retainers thereon, and two bendable center sheet retainers formed from material bent up from said body between said side sheet retainers, said sheet retainers each having a lock accommodating zone thereon;

a keeper having two side apertures and a center aperture, said side apertures spaced to receive said side sheet retainers therethrough, and said center aperture located to receive said center sheet retainers therethrough; and four locks mounted on said keeper to selectively engage said lock accommodating zones when said sheet retainers are bent against said keeper.

2. The fastener for sheet material of claim 1, wherein:

each said sheet retainer includes a pair of raised surfaces each forming thereon a lock detent, said pair of raised surfaces spaced to define one of said lock accommodating zones therebetween.

3. The fastener for sheet material of claim 1, wherein:

said body includes two side edges, said side sheet retainers are located adjacent said side edges, said side sheet retainers are formed from material bent up from said body between said side edges and extend upwardly from said side edges toward each other.

4. The fastener for sheet material of claim 1, wherein:

said body has a longitudinal dimension and a lateral dimension;

said side sheet retainers formed from material bent up from said body between said side edges;

each said side sheet retainer having a complementary one of said center sheet retainers, each said side sheet retainer and said complementary center sheet retainer extending longitudinally toward each other and overlapping laterally adjacent each other.

5. A fastener for sheet material, comprising:

a base having an upper surface, two side sheet retainers spaced on said base and extendable upwardly from said base upper surface, and two intermediate sheet retainers extendable upwardly from said base upper surface, said intermediate sheet retainers disposed on said base between said side sheet retainers;

a keeper having an upper surface and having two side apertures and an intermediate aperture therethrough, said side apertures spaced to selectively receive said side sheet retainers therethrough, and said intermediate aperture located to receive said intermediate sheet retainers therethrough; and four locks mounted on said keeper, said side sheet retainers and said intermediate sheet retainers bendable to extend along said keeper upper surface, and said locks disposed to selectively secure said sheet retainers against said keeper upper surface.

* * * * *